United States Patent [19]

Raab et al.

[11] Patent Number: 4,539,446

[45] Date of Patent: Sep. 3, 1985

[54] SLIDE ACTION SWITCH

[75] Inventors: Andrew F. Raab, Morton Grove; Albert R. Cobb, III, Glenview, both of Ill.

[73] Assignee: Indak Manufacturing Corp., Northbrook, Ill.

[21] Appl. No.: 615,036

[22] Filed: May 29, 1984

[51] Int. Cl.[3] ..... H01H 15/06

[52] U.S. Cl. ..... 200/16 R; 200/16 C

[58] Field of Search ..... 200/16 C, 16 D, 16 R, 200/16 A, 16 B, 16 E, 16 F, 68.2, 329, 339

[56] References Cited

U.S. PATENT DOCUMENTS

| | | | |
|---|---|---|---|
| 3,472,975 | 10/1969 | Soreng et al. | 200/16 C |
| 3,500,003 | 3/1970 | Schink | 200/16 C |
| 4,463,237 | 7/1984 | Kim | 200/340 |

*Primary Examiner*—A. D. Pellinen
*Assistant Examiner*—Morris Ginsburg
*Attorney, Agent, or Firm*—Burmeister, York, Palmatier, Hamby and Jones

[57] ABSTRACT

A slide action electrical switch, comprising a casing, a carriage mounted in the casing for sliding movement along a predetermined path, an electrically conductive contactor mounted on the carriage, electrical contact means on the casing and selectively engageable by the contactor during movement thereof with the carriage along the path, such casing having a front wall with a rearwardly facing surface along which the carriage is slidable, such casing having a slot extending through the front wall and generally parallel with such path of the carriage, and an operating member slidable along the front surface of the front wall, such operating member comprising a rearwardly extending portion including a pair of prongs extending through and slidable along the slot, such carriage having a retaining slot for receiving the prongs, such prongs being flexible and resilient and having rear end portions with ratchet teeth thereon for deflecting the prongs toward each other as they are inserted through the retaining slot during the assembly of the prongs into the retaining slot, such prongs being operative to snap away from each other with the ratchet teeth locked behind the carriage when the prongs are fully inserted through the retaining slot in the carriage. A spring is preferably provided to bias the carriage toward one end of its path. Preferably, the operating member is sufficiently longer than the slot in the front wall to cover such slot throughout the range of movement of the operating member. The casing, the carriage and the operating member are preferably made of resinous plastic materials.

18 Claims, 29 Drawing Figures

40
68
38
64
66
36
70
34
48
54
52
102
78
80
32
82
76
84
86
88
90

40
48
108
38
106
36
62
60
32
109
58
52
110
56
80
126
78
84
128
76
86
88
90

90

90

90

76
92
94
96

76
92
94

94
92
96
76

78
80
82

78
80
82
76
78
80

SLIDE ACTION SWITCH

FIELD OF THE INVENTION

This invention relates to a new and improved slide action switch which will have many applications, but is particularly well adapted for use in automobiles and other automotive vehicles.

BACKGROUND OF THE INVENTION

A wide variety of switches have been produced for use on the dashboard and elsewhere in automobiles and other automotive vehicles, for controlling various functions and components of the vehicle. For example, such switches have been produced of the lever action type, the rocker type and the push button type. In some cases, such switches have been of the detented type or the latching type, to produce a plurality of definite operating positions. In other cases, such switches have been of the spring returned type, having a biasing spring for returning the operating member of the switch to its initial position, after the operating member has been moved momentarily to its actuated position.

One principal object of the present invention is to provide a new and improved control switch, particularly for use on vehicles, and having a slide action, in that the operating member of the switch is slidable to a plurality of positions by the operator of the vehicle.

A further object is to provide such a new and improved slide action switch which is reliable, easy to operate, highly compact, attractive in appearance, easy to assemble and low in cost.

SUMMARY OF THE INVENTION

To achieve these and other objects, the present invention preferably provides an electrical switch, comprising a casing, a carriage mounted in said casing for sliding movement along a predetermined path, an electrically conductive contactor mounted on said carriage, electrical contact means on a contact supporting board in the casing and selectively engageable by said contactor during movement thereof with said carriage along said path, said casing having a front wall with a rearwardly facing surface along which said carriage is slidable, said casing having a slot extending through said front wall and generally parallel with said path of said carriage, said front wall having a front surface, and an operating member slidable along said front surface of said front wall, said operating member comprising a rearwardly extending member including a pair of prongs extending through and slidable along said slot, said carriage having a retaining slot for receiving said prongs, said prongs being flexible and resilient and having rear end portions with latching elements thereon for deflecting said prongs as said prongs are inserted through said retaining slot during the assembly of said prongs into said retaining slot, said prongs being operative to return resiliently to their undeflected positions with said latching elements interlocked with said carriage when said prongs are fully inserted into said retaining slot in said carriage.

The latching elements are preferably in the form of ratchet teeth, projecting outwardly in opposite directions. The distance between the extremities of the ratchet teeth is preferably greater than the length of the retaining slot in the carriage, so that the prongs are deflected toward each other as they are inserted through such slot.

The length of the operating member is preferably substantially greater than the length of the slot in the front wall, so that such slot is covered by the operating member throughout its range of movement.

The operating member and the prongs are preferably made of a resilient resinous plastic material. The casing and the carriage are also preferably made of resinous plastic materials.

It is preferred to provide resilient means, such as a spring, for biasing the carriage toward one end of its path of sliding movement.

BRIEF DESCRIPTIONS OF THE DRAWINGS

Further objects, advantages and features of the present invention will appear from the following description, taken with the accompanying drawings, in which.

Figure 2:
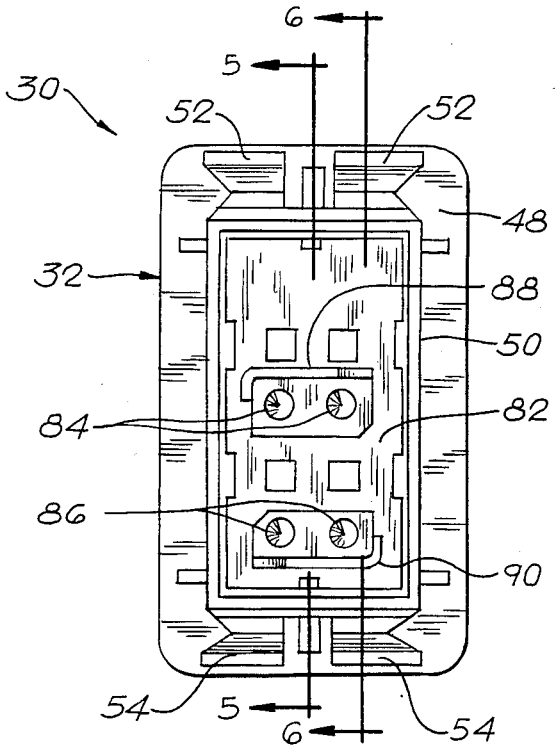
FIG. 2 is a rear elevation.
Figure 4:
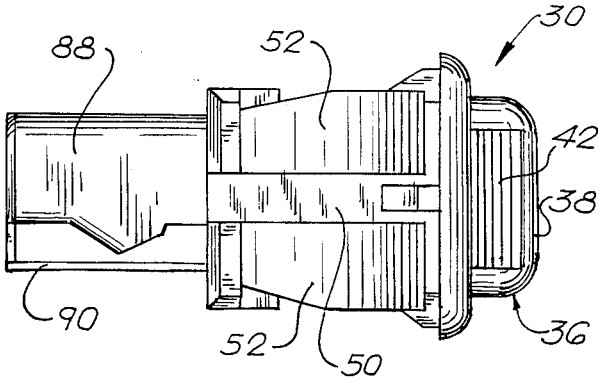
FIG. 4 is a top plan view.
Figures 5, 6, 7, 8, 9, 10, 11, 12, 13, 14:
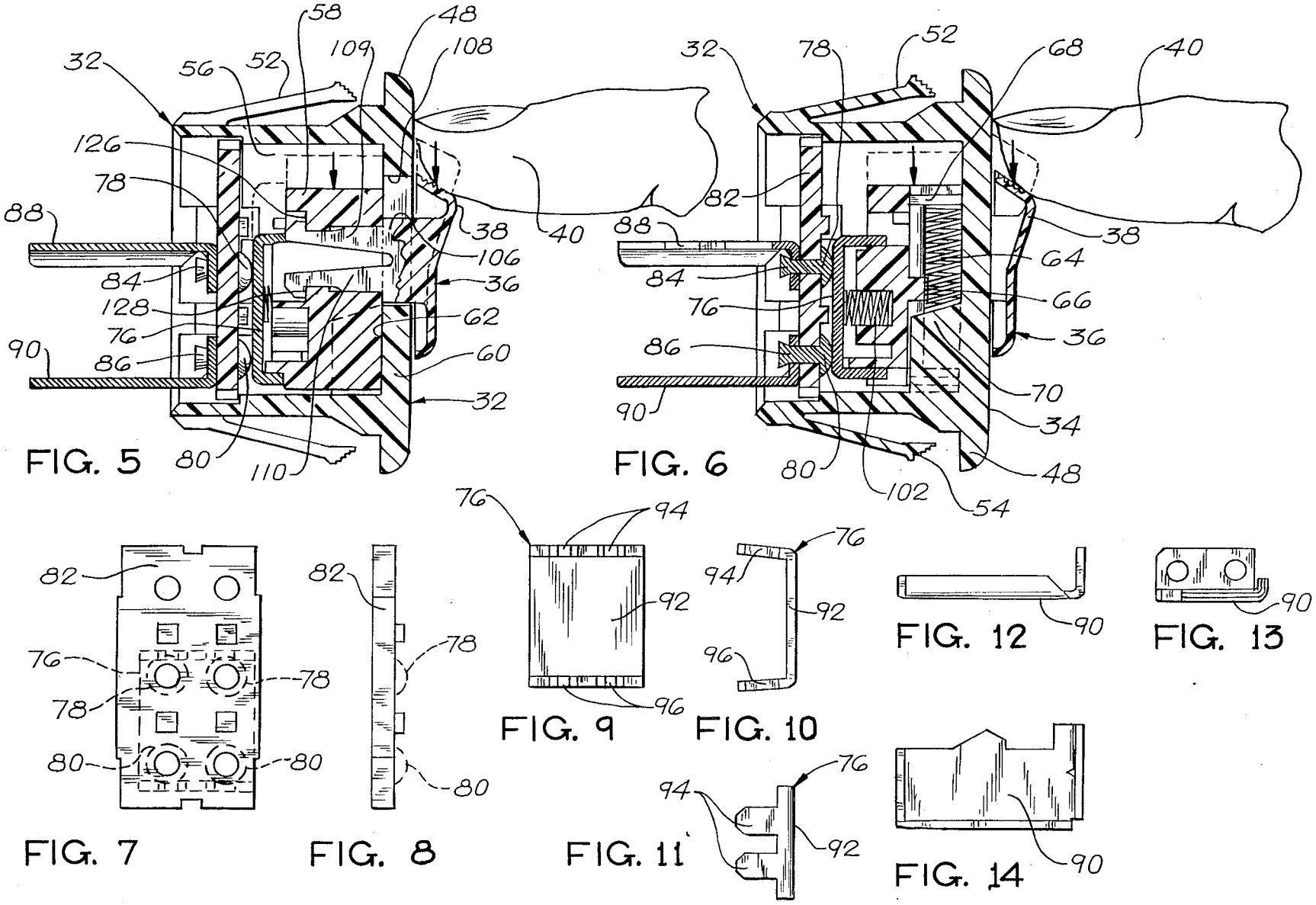

FIGS. 5 and 6 are vertical sections, taken generally along the lines 5—5 and 6—6 in FIG. 2.

FIG. 7 is a front elevation of the contact supporting board for the switch, the contacts and the contactor being shown in broken lines.

FIG. 8 is a side elevation of the contact supporting board of FIG. 7, the contacts being shown in broken lines.

FIGS. 9, 10 and 11 are front, side and top views of the movable contactor for the switch.

FIGS. 12, 13 and 14 are side, rear and plan views of one of the electrical terminals for the switch.

Figure 16:
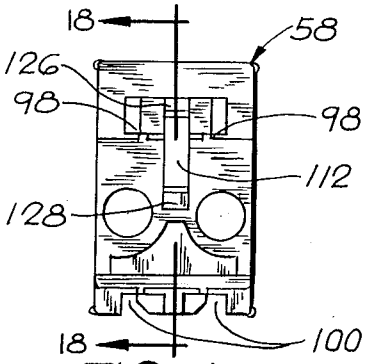
Figure 15:
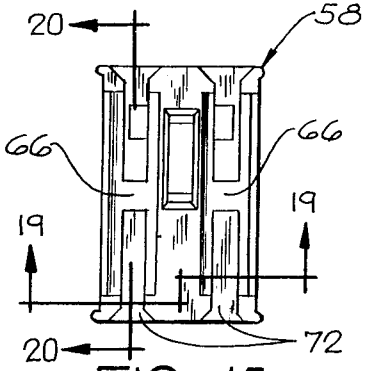

FIGS. 15 and 16 are front and rear elevations of the carriage for the switch.

Figure 17:
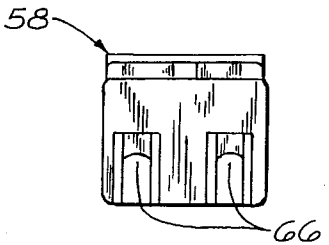

FIG. 17 is a top view of the carriage.

Figure 18:
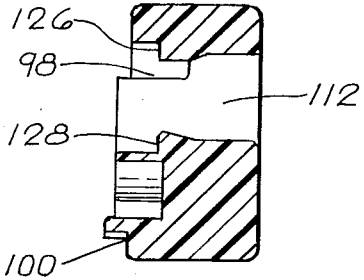

FIG. 18 is a vertical section, taken generally along the line 18—18 in FIG. 16.

Figure 19:
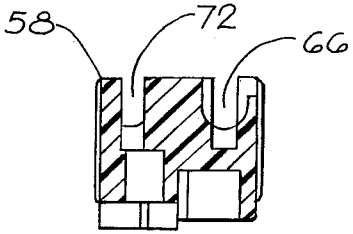

FIG. 19 is a horizontal section, taken generally along the broken line 19—19 in FIG. 15.

Figure 20:
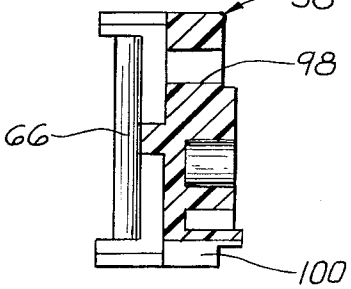

FIG. 20 is a vertical section, taken generally along the line 20—20 in FIG. 15.

Figure 21:
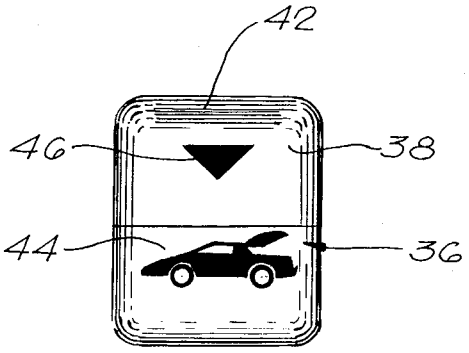

FIG. 21 is a front view of the operating member for the switch.

Figure 22:
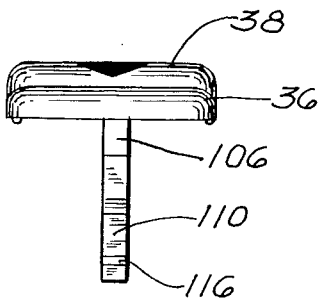
Figure 23:
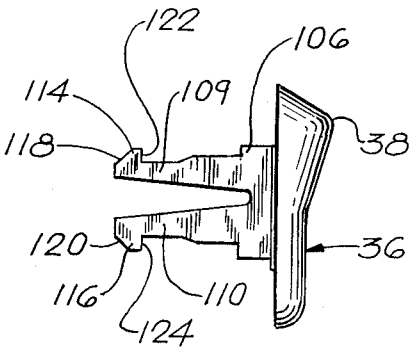

FIGS. 22 and 23 are bottom and side views of the operating member.

Figure 1:
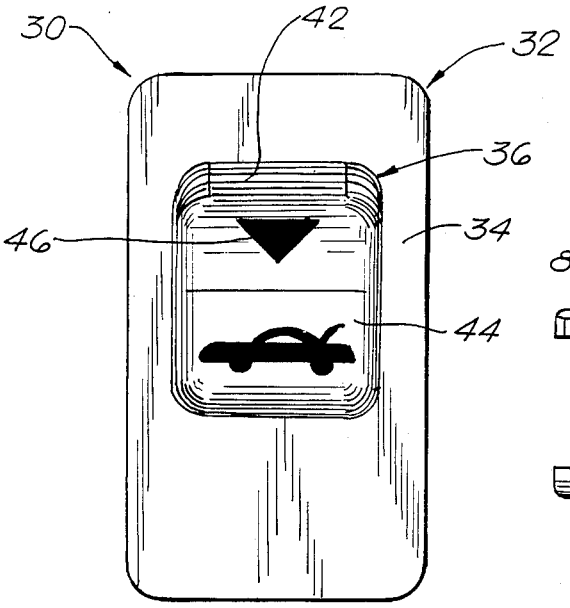
FIG. 1 is an enlarged front elevational view of a slide action switch to be described as an illustrative embodiment of the present invention.
Figure 3:
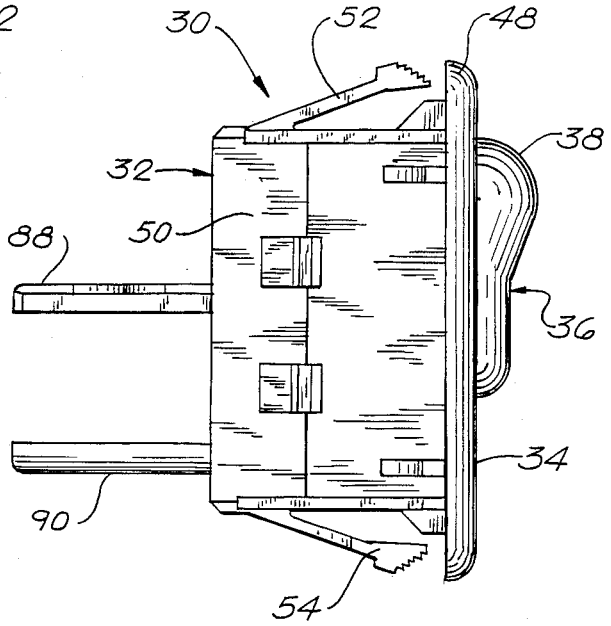
FIG. 3 is a side elevation.

FIGS. 24, 25, 26 and 27 are front, rear, side and top views of the casing for the switch of FIG. 1.

Figure 24:
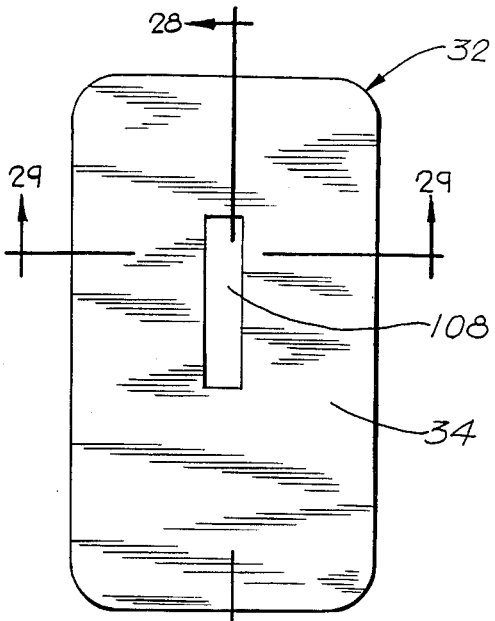
Figure 26:
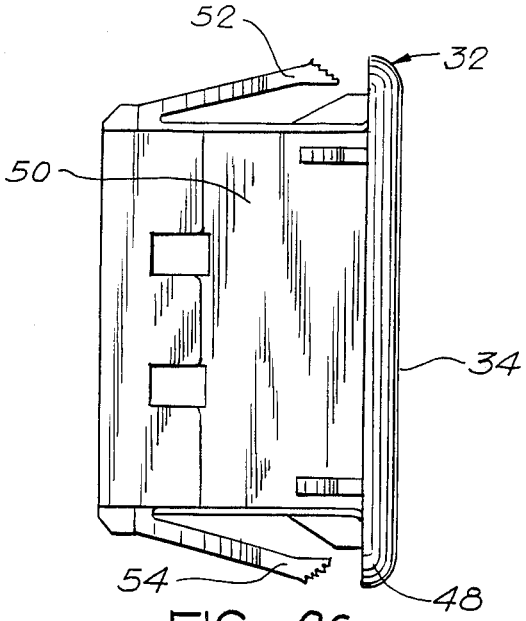
Figure 28:
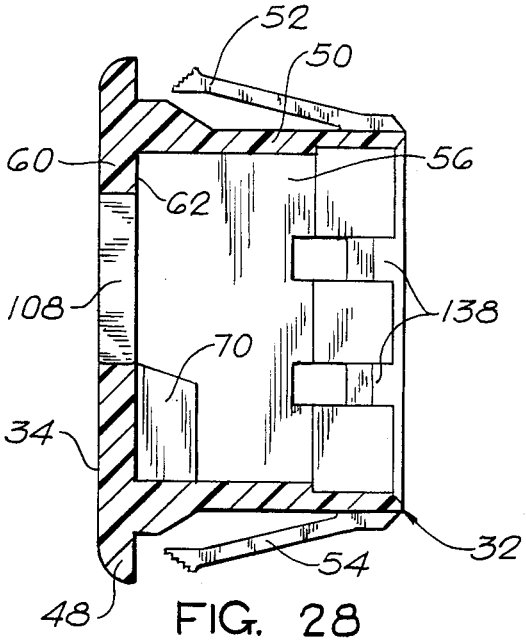
Figure 29:
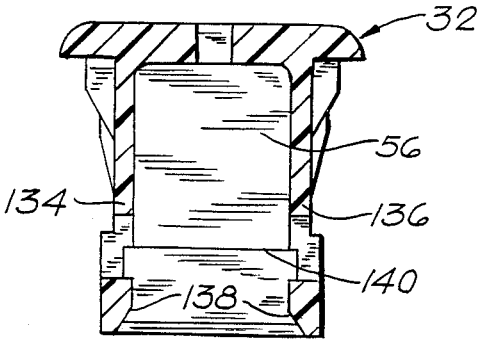
Figure 27:
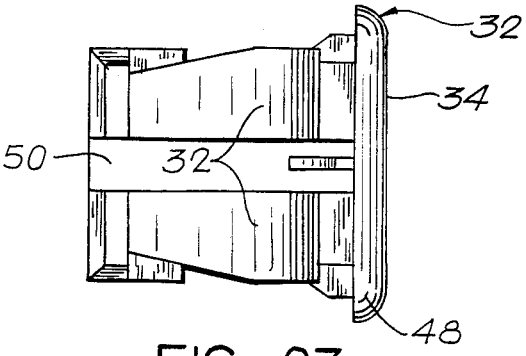

FIGS. 28 and 29 are vertical and horizontal sections, taken generally along the line 28—28 and 29—29 in FIG. 24.

DETAILED DESCRIPTION OF AN ILLUSTRATIVE EMBODIMENT

As just indicated, the drawings, and particularly FIGS. 1–6, illustrate a slide action switch 30 which will find many applications, but is particularly advantageous for use on the dashboard of an automobile or some other automotive vehicle, for controlling a function or component of the vehicle. In this case, the switch 30 is intended specifically to close an electrical circuit which operates a latch releasing solenoid or other device for the rear hatch cover of the vehicle. The switch 30 is very small and compact but is illustrated on an enlarged scale in the drawings.

It will be seen from FIGS. 1–6 that the slide action switch 30 comprises a casing 32 having a front surface 34 along which an operating member 36 is slidable. The casing 32 and the operating member 36 are preferably made of resinous plastic materials.

The operating member 36 is formed with a forwardly projecting protuberance or knob 38 which is adapted to be engaged by one finger 40 of the operator, as shown in FIGS. 5 and 6. The knob 38 is formed with a non-slip surface 42 which is serrated or grooved, for non-slip engagement by the operator's finger 40.

The function of the switch 30 is indicated by an illustration 44 on the operating member 36. Such illustration 44 shows an automobile with its rear hatch cover swung upwardly. The operating member 36 is actuated by sliding the operating member 36 downwardly along the front wall 34, as indicated by an arrow 46 on the operating member 36.

The casing 32 has a front flange 48 which is adapted to engage the dashboard of the automobile. In this case, the front flange 48 is in the shape of a rectangle with rounded corners. To the rear of the front flange 48, the casing 32 has a main or rear casing portion 50 which is adapted to be inserted through an opening in the dashboard. As shown, the rear casing portion 50 is generally rectangular in shape. The casing portion 50 may be retained in the dashboard opening by two spring arms 52 and 54, formed on the upper and lower sides of the casing portion 50.

The casing 32 has a generally rectangular interior space 56 in which a carriage 58 is slidable along a predetermined path. In this case, such path is vertical. The illustrated casing 32 has a front wall 60 with a rear surface 62, along which the carriage 58 is slidable.

Figure 25:
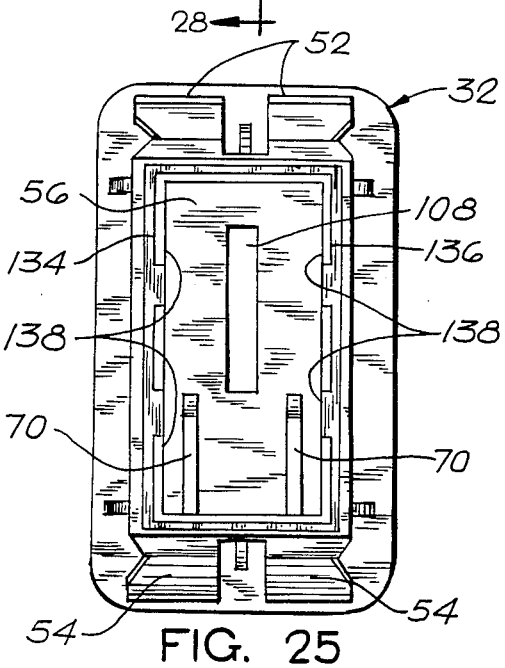

The carriage 58 is preferably biased toward one end of its path by resilient means, illustrated as a spring 64, which biases the carriage 58 upwardly in this instance. As shown, the spring 64 is received in a nest or recess 66, formed in the front side of the carriage 58. In this case, the carriage 58 is actually formed with two such recesses 66, either of which may be employed to receive the spring 64. The upper end of the spring 64 engages a flange 68 on the carriage 58. The lower end of the spring 64 is engaged by a vertical flange or fin 70 on the casing 32. In this case, there are actually two such flanges 70, as shown in FIG. 25, for entering the two recesses 66 through slots 72 in the lower ends thereof.

The movable carriage 58 carries an electrically conductive contactor 76 which is selectively engageable with contact means on the contact supporting board 82. Such contact means may take the form of pairs of fixed contacts 78 and 80, mounted on a contact supporting board 82 which forms the rear wall of the casing 32.

The illustrated contacts 78 and 80 are in the form of spherically rounded heads or contact points on rivets 84 and 86 which extend through holes in the mounting board 82. Electrically conductive terminals or prongs 88 and 90 are secured to the board 82 by means of the rivets 84 and 86. The terminals 88 and 90 are adapted to receive a suitable electrical receptacle or connector.

As shown most clearly in FIGS. 9–11, the contactor 76 may comprise a conductive metal plate 92, made of copper or the like, and formed with prongs or tabs 94 and 96 which are slidably received in slots or recesses 98 and 100, formed in the rear side of the carriage 58. The contactor 76 is biased rearwardly by resilient means, illustrated as springs 102 acting between the carriage 58 and the contactor 76.

In this case, the contactor 76 engages the contact points 78 throughout the range of movement of the carriage 58. When the carriage 58 is biased to the upper end of its path by the return spring 64, the contactor 76 is out of engagement with the contacts 80. When the operating member 36 and the carriage 58 are moved downwardly, the contactor 76 engages the contact points 80 to close the electrical circuit between the terminals 88 and 90.

In the illustrated switch 30, the assembly of the switch is greatly facilitated by providing a rearwardly projecting portion 106 on the operating member 36, to connect the operating member 36 to the carriage 58. The rearwardly projecting portion 106 is preferably molded in one piece with the operating member 36. As shown in FIG. 5, the rearwardly projecting portion 106 extends through and is slidable along a vertical slot 108, formed in the front wall 60 of the casing 32.

As shown most clearly in FIGS. 5 and 23, the rearwardly projecting portion 106 of the operating member 36 is formed with flexible resilient latching prongs 109 and 110 which are inserted through the slot 108 when the switch 30 is being assembled. The prongs 109 and 110 are then pushed through a slot 112 formed in the carriage 58. The prongs 109 and 110 have rear end portions formed with latching elements or ratchet teeth 114 and 116 which cause deflection of the prongs 109 and 110 toward each other, as the ratchet teeth 114 and 116 are pushed through the slot 112 in the carriage 58. Such deflection arises from the fact that the length of the slot 112 is less than the distance between the oppositely projecting extremities of the ratchet teeth 114 and 116. Such teeth have inclined ramps 118 and 120 which cause deflection of the prongs 109 and 110 toward each other, as the ratchet teeth 114 and 116 are pushed into the slot 112 in the carriage 58.

When the prongs 109 and 110 have been pushed fully into the slot 112, as shown in FIG. 5, the ratchet teeth 114 and 116 emerge from the rear end of the slot 112, whereupon the prongs 109 and 110 spring outwardly again, away from each other, while the ratchet teeth 114 and 116 move outwardly into interlocking or latching engagement with the carriage 58, as shown in FIG. 5. The ratchet teeth 114 and 116 have forwardly facing abutment surfaces 122 and 124 which interlock with corresponding rearwardly abutment surfaces 126 and 128 on the carriage 58, as shown in FIGS. 16 and 23.

The guide slot 108 in the front wall 60 of the casing 32 is longer than the retaining slot 112 in the carriage 58. The guide slot 108 is sufficiently long to provide for the full range of vertical movement of the operating member 36. However, the operating member 36 is substantially longer than the guide slot 108, so that the slot 108 is fully covered by the operating member 36, throughout its range of operating movement. In this way, the appearance of the switch 30 is improved. Moreover, the operating member 36 prevents the entry of foreign bodies into the guide slot 108.

The contact supporting board 82 is assembled with the casing 32 by pushing the board 82 with sufficient force into the rear end of the rectangular opening 56 in the casing. As shown in FIG. 29, the casing 32 has side walls 134 and 136 formed with two pairs of ratchet teeth 138 which cause the side walls to be deflected outwardly as the board 82 is pushed into the opening 56. The board 82 is pushed against a rearwardly facing abutment or shoulder 140, whereupon the ratchet teeth 138 spring back inwardly, behind the board 82, to latch it in place by interlocking engagement between the ratchet teeth 138 and the rear side of the board 82.

If desired, the carriage 58 may be provided with two of the return springs 64, received in the two recesses 66.

We claim:

1. An electrical switch, comprising a casing, a carriage mounted in said casing for sliding movement along a predetermined path, an electrically conductive contactor mounted on said carriage, electrical contact means on said casing and selectively engageable by said contactor during movement thereof with said carriage along said path, said casing having a front wall with a rearwardly facing surface along which said carriage is slidable, said casing having a slot extending through said front wall and generally parallel with said path of said carriage, said front wall having a front surface, and an operating member slidable along said front surface of said front wall, said operating member comprising a rearwardly extending portion including a pair of prongs extending through and slidable along said slot, said carriage having a retaining slot for receiving said prongs, said prongs being flexible and resilient and having rear end portions with ratchet teeth thereon for deflecting said prongs toward each other as said prongs are inserted through said retaining slot during the assembly of said prongs into said retaining slot, said prongs being operative to snap away from each other with said ratchet teeth locked behind said carriage when said prongs are fully inserted through said retaining slot in said carriage.

2. An electrical switch according to claim 1, said operating member and said prongs being made of a resinous plastic material.

3. An electrical switch according to claim 1, including resilient means biasing said carriage toward one end of said path of movement.

4. An electrical switch according to claim 1, including a spring biasing said carriage toward one end of said path of movement.

5. An electrical switch according to claim 1, said casing, said carriage and said operating member, including said prongs, being made of resinous plastic materials.

6. An electrical switch, comprising a casing, a carriage mounted in said casing for sliding movement along a predetermined path, an electrically conductive contactor mounted on said carriage, electrical contact means on said casing and selectively engageable by said contactor during movement thereof with said carriage along said path, said casing having a front wall with a rearwardly facing surface along which said carriage is slidable, said casing having a slot extending through said front wall and generally parallel with said path of said carriage, said front wall having a front surface, and an operating member slidable along said front surface of said front wall, said operating member comprising a rearwardly extending member including a pair of prongs extending through and slidable along said slot, said carriage having a retaining slot for receiving said prongs, said prongs being flexible and resilient and having rear end portions with latching elements thereon for deflecting said prongs as said prongs are inserted through said retaining slot during the assembly of said prongs into said retaining slot, said prongs being operative to return resiliently to their undeflected positions with said latching elements interlocked with said carriage when said prongs are fully inserted into said retaining slot in said carriage.

7. An electrical switch according to claim 6, said operating member and said prongs being made of a resinous plastic material.

8. An electrical switch according to claim 6, said casing, said carriage and said operating member, including said prongs, being made of resinous plastic materials.

9. An electrical switch according to claim 6, including resilient means biasing said carriage in one direction along said path.

10. An electrical switch according to claim 6, including a spring biasing said carriage toward one end of said path of movement.

11. A slide action electrical switch, comprising a casing, a carriage mounted in said casing for sliding movement along a predetermined path, an electrically conductive contactor mounted on said carriage, electrical contact means on said casing and selectively engageable by said contactor during movement thereof with said carriage along said path, said casing having a front wall with a rearwardly facing surface along which said carriage is slidable, said casing having a slot extending through said front wall and generally parallel with said path of said carriage, said front wall having a front surface, and an operating member slidable along said front surface of said front wall, said operating member comprising a rearwardly extending portion including a pair of prongs extending through and slidable along said slot, said carriage having a retaining slot for receiving said prongs, said prongs being flexible and resilient and having rear end portions with ratchet teeth directed outwardly in opposite directions thereon for deflecting said prongs toward each other as said prongs are inserted through said retaining slot during the assembly of said prongs into said retaining slot, said prongs being operative to snap away from each other with said ratchet teeth locked behind said carriage when said prongs are fully inserted through said retaining slot in said carriage, said retaining slot in said carriage being substantially shorter than said slot in said front wall, said prongs having a distance between the extremities of said ratchet teeth which is less than the length of said retaining slot whereby said prongs are deflected toward each other when said prongs are inserted into said retaining slot.

12. A switch according to claim 11, said operating member and said prongs being made of a resilient resinous plastic material.

13. A switch according to claim 12, said casing and said carriage being made of resinous plastic materials.

14. A switch according to claim 11, including resilient means biasing said carriage toward one end of said path.

15. A switch according to claim 11, including a spring biasing said carriage toward one end of said path of movement.

16. A switch according to claim 11, said operating member having a length substantially greater than the length of said slot in said front wall for covering said slot in said front wall throughout the range of sliding movement of said operating member.

17. A switch according to claim 1, said operating member having a length substantially greater than the length of said slot in said front wall for covering said slot in said front wall throughout the range of sliding movement of said operating member.

18. A switch according to claim 6, said operating member having a length substantially greater than the length of said slot in said front wall for covering said slot in said front wall throughout the range of sliding movement of said operating member.

* * * * *